United States Patent [19]

Hill et al.

[11] Patent Number: 4,979,846

[45] Date of Patent: Dec. 25, 1990

[54] CONTRACTION JOINT FOR CONCRETE LININGS

[75] Inventors: Ronald A. Hill, 5033 W. Condor Dr., Tucson, Ariz. 85741; Thomas J. Gorman, 8271 N. Wanda Ave., Tucson, Ariz. 85704

[73] Assignees: Ronald A. Hill; Thomas J. Gorman, both of Tucson, Ariz.

[21] Appl. No.: 271,834

[22] Filed: Nov. 16, 1988

[51] Int. Cl.[5] ..... E01C 11/10

[52] U.S. Cl. ..... 404/65; 52/396; 52/403

[58] Field of Search ..... 404/2, 64, 65, 66, 67, 404/55, 47; 52/396, 403, 573

[56] References Cited

U.S. PATENT DOCUMENTS

| | | | |
|---|---|---|---|
| 3,172,237 | 3/1965 | Bradley | 52/396 X |
| 3,583,120 | 6/1971 | Wangerow | 404/65 X |
| 3,808,762 | 5/1974 | Hurst | 404/65 |

FOREIGN PATENT DOCUMENTS

| | | | |
|---|---|---|---|
| 702238 | 1/1965 | Canada | 404/65 |
| 597452 | 4/1978 | Switzerland | 52/396 |
| 1103115 | 2/1968 | United Kingdom | 52/396 |

*Primary Examiner*—Stephen J. Novosad
*Attorney, Agent, or Firm*—E. Philip Koltos

[57] ABSTRACT

A contraction joint for use in forming a layer of concrete is disclosed which comprises a base, a central projection extending from the base having an upper apex section of uniform thickness and a lower triangular section having a cut-out portion to assist in the contraction and expansion of the joint, a plurality of water stops attached to the base, at least one on each side of the central projection, and a plurality of elongated ribs located between the water stops and the central projection. The joint is designed to be positioned so that the tip of the central projection is disposed at or slightly above the level of the surface of the layer of concrete formed above the joint. The use of the joint prevents a bond from forming in two adjoining concrete panels so that deterioration at the panel interface is reduced, stress in the concrete is relieved, and buckling is prevented. The joint is made of a flexible, durable material, and is particularly suitable for use in the preparation of concrete-lined structures for water conveyance systems such as canals or reservoirs.

9 Claims, 1 Drawing Sheet

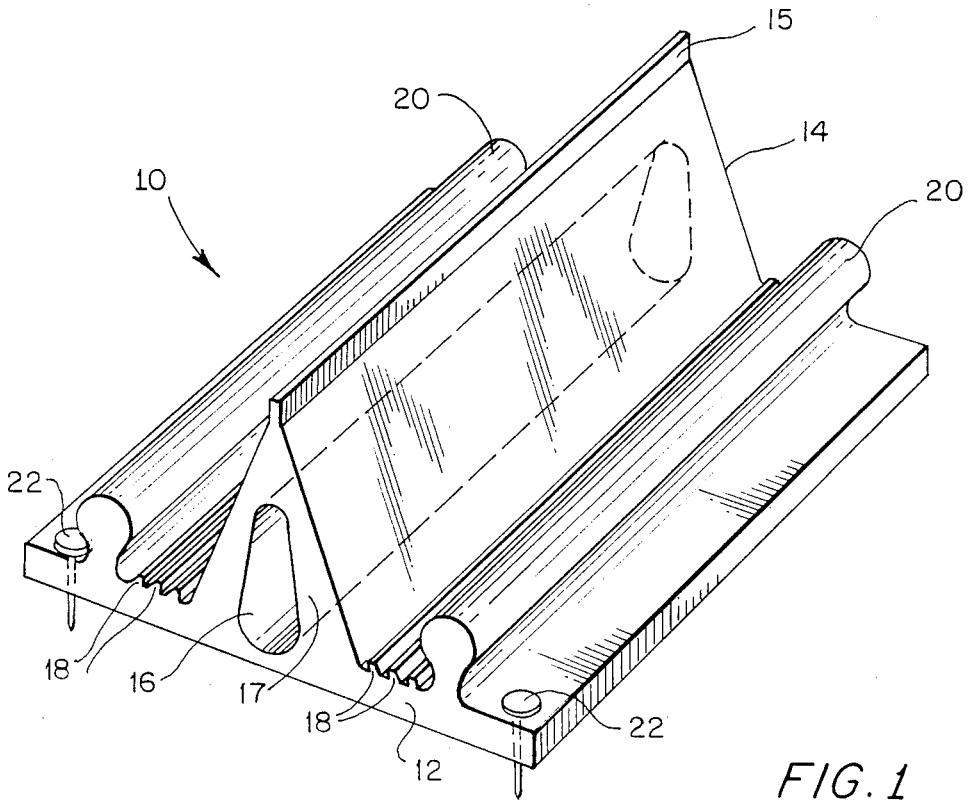
FIG. 1
FIG. 2
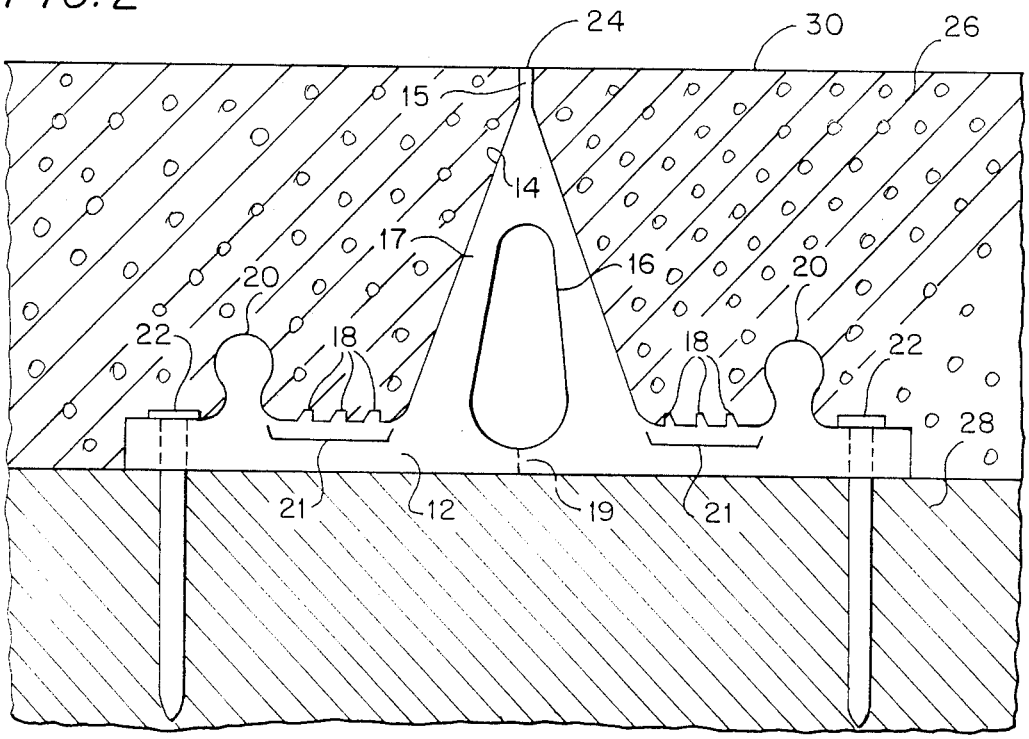

CONTRACTION JOINT FOR CONCRETE LININGS

FIELD OF THE INVENTION

The invention relates to a contraction joint for use in forming a layer of concrete, and more particularly to a contraction joint for use in a monolithic method of forming concrete linings suitable for use in water conveyance systems, such as canals or reservoirs.

BACKGROUND OF THE INVENTION

There has long been recognized the need for inserting contraction joints into a wide variety of paved structures in order to prevent buckling and to ensure proper concrete consolidation. Such joints are crucial in providing stability to the paved structures, yet must also be constructed in such a manner as to undergo minimal deterioration when exposed to the elements. This is particularly true in the case of joints designed for use in concrete linings of water conveyance systems such as canals or reservoirs which are constantly underwater. Joints used in such systems must be able to maintain flexibility to allow expansion and contraction of the concrete lining, durable enough to withstand pressure and the elements, and engineered precisely enough to form a homogenous water-tight contraction joint in the paved lining.

In the past, various devices have been used for the insertion of joints in concrete linings of water convenience systems and other structures. These attempts generally have suffered from various drawbacks such as rapid deterioration, poor bonding capabilities, or inconvenience and expense in their application. An example of one such prior art device is the preformed mastic strip which has been used to form joints in concrete linings but suffers from all of the aforementioned problems. Other prior art devices in this field which also encounter similar problems include PVC T-strips, which are presently used in water conveyance construction.

Other devices known in the prior art include joints which are placed on the subgrade before concrete is poured over them, and these joints allow the formation of cracks in the pavement along a plane of weakness above the joint when the concrete undergoes contraction. This controlled cracking relieves the stresses in the concrete layer and thus acts to prevent further cracking or buckling. Examples of this type of joint are disclosed in U.S. Pat. Nos. 2,806,414 (Woodman) and 3,583,120 (Wangerow). In the Woodman patent, a metallic forming strip is disclosed having an inverted V-shaped central projection, two V-shaped ridges on the sides of the central projection, and a series of apertures in the strip to allow spikes to be inserted to anchor the strip in the subgrade. In the Wangerow patent, the joint structure disclosed at FIGS. 1 and 2 has a thin central fin disposed between two rail-shaped anchoring members. However, the devices disclosed in these two patents both suffer from the drawback that their thin central fins are not rugged enough to withstand the pressures associated in a water conveyance system, and, as can be observed in FIG. 2 in both patents, the fins extend only through a small portion of the overlying concrete. This distance is described in the Wangerow patent as approximately one-third of the concrete layer (see column 2, lines 54–58). As a result of the height of the fin, a substantial portion of the pavement above the fin undergoes cracking when the concrete contracts or expands.

Since there is often some amount of breakup in the concrete at the interface of adjoining panels caused by movement of the panels, these cracks increase the possibility of damage and deterioration of the concrete layer and of the joint structure. This again would particularly be a problem with regard to use of these two joints in concrete-lined water conveyance systems.

It is thus highly desirable to develop a device for forming a water-tight contraction joint in concrete linings such as would be used in a water conveyance system, one which can ensure proper consolidation and prevent buckling, yet which is designed to reduce concrete deterioration and better withstand the elements. It is also desirable that such a device can be constructed simply and inexpensively, and be easily used in monolithic methods of preparing concrete linings and other paved structures.

SUMMARY OF THE INVENTION

In accordance with the present invention, a contraction joint for use in forming a layer of concrete is provided which comprises:

a base which can be affixed to the ground;

a central projection extending upwardly from said base so that the height of said projection will approximate the level of the surface of the formed layer of concrete, said projection having an upper apex section of uniform thickness and a generally triangular lower section having a cut-out portion to assist in the contraction and expansion of the joint;

a plurality of water stops extending upwardly from said base, at least one pair of said water stops located on opposite sides of said central projection; and a plurality of elongated ribs extending upwardly from said base and located between said water stops and said central projection, at least one pair of said ribs located on opposite sides of said triangular projection.

Such a contraction joint can be used in the formation of a concrete layer so that the upper section of the central projection provides a buffer at the interface of two adjoining concrete panels so as to give stability, prevent against buckling, and minimize the deterioration of the concrete at that interface. In addition, the water stops and elongated ribs of the joint act to exclude water which may penetrate downward between the panels from reaching the subgrade. As a result of these features, the contraction joint of the present invention can advantageously be used in concrete-lined water conveyance systems such as canals or reservoirs.

BRIEF DESCRIPTION OF THE DRAWING FIGURES

FIG. 1 is a perspective view of a contraction joint prepared in accordance with the present invention.

FIG. 2 is transverse cross-section of the joint of FIG. 1 as installed in a layer of concrete.

DETAILED DESCRIPTION OF THE PREFERRED EMBODIMENTS

A contraction joint prepared in accordance with the present invention can be observed in FIGS. 1 and 2. The contraction joint 10 for use in forming concrete linings comprises a base 12, a central projection 14 which extends upwardly from the base, at least two water stops 20 which also extend upwardly from the base, with at least one stop on each side of the central projection 14, and a plurality of elongated ribs 18 located on the base 12 between water stops 20 and the central projection. It is desired to have at least one of the ribs 18 on each side of central projection 14. The joint can be affixed to the ground or subgrade 28 by means of spikes 22 which can be placed through base 12 at its outer edges, as best observed in FIG. 2. Other conventional methods, e.g., adhesives, etc., may also be used to securely bond joint 10 to the subgrade, but use of spikes is the preferred mode.

The contraction joint 10 of the present invention is designed to be affixed to the subgrade 28, on top of which a concrete lining is to be placed. The central projection 14 of joint 10 will approximate the height of the concrete layer, and the tip 24 of the projection (or inspection fin) will end up at or just slightly above the level of the surface 30 of the formed layer of concrete 26. Forming a layer of concrete using joint 10 thus creates a plane of weakness in the pavement 26 so that bonding will not occur between two adjoining panels. As a result, two independent members are formed when the concrete contracts. The formation of these members operates to eliminate the stresses normally occurring in the pavement due to this contraction, and acts to stabilize the concrete and prevent further cracking or buckling. By constructing a concrete layer using the joint of the present invention, deterioration of the concrete structure caused by contact at the interface between two adjoining panels is eliminated. The present invention thus provides a homogenous water-tight contraction joint which is ideal for use in a monolithic method of constructing a concrete lining for water conveyance structures.

The contraction joint of the present invention is preferably comprised of any durable, elastic, inexpensive material which is flexible, yet able to withstand the rigorous conditions associated with a water conveyance system. Ideally, the joint will be comprised of rubber or a rubber-like polymer having the required characteristics of durability and flexibility. Among the many polymers suitable for use in the present invention are polyvinylchloride, polyurethane, polybutadiene, polyisoprene blends, ethylene-propylene co- and ter polymers, and any other suitable thermoplastic compositions. Polyvinylchloride (PVC) is particularly preferred.

As can be observed in the drawing figures, the central projection 14 is comprised of an upper apex section 15 of uniform thickness and a generally triangular lower section 17 which includes cut-out portion 16. The cut-out portion 16 is provided to assist in the contraction and expansion of joint 10 caused by the movement of the concrete. The actual dimensions and shape of the cut-out portion can be varied, but the cutout is preferably disposed so as to not affect the structural stability of central projection 14. If desired, however, the lower half of the cutout can be constructed so that there is only a small portion 19 of base 12 below cutout 16. When the joint 10 is constructed in this manner, the base 12 will separate at point 19 upon expansion or contraction of the concrete, which relieves the stress associated with the joint and further assists in the joint's flexibility.

The joint of the present invention is also designed to provide a means whereby any water which may seep downward past tip 24 is prevented from reaching the subgrade 28. This feature is provided by the two water stops 20 and the series of ribs 18 which are positioned in channel 21 between the water stops and the central projection 14. Any water arriving at the base is stopped by ribs 18 or eventually by the water stops 20. In this way, accumulation of water in the subgrade under the pavement is prevented, and buckling due to deterioration of the subgrade is avoided. Ideally, the water stops 20 extend upwardly from base 12 and are characterized by the round-shaped tops as observed in the drawing figures. However, other configurations for the water stops, e.g., rail-shaped, triangular, etc., are also possible. Additionally, it is also noted that in the embodiment shown in the drawing figures, there are three ribs on each side of projection 14; however, greater or lesser numbers of ribs in channel 21 can also be employed as desired.

The actual dimensions of the joint of the present invention can vary greatly depending on the desired thickness of the concrete layer or the ultimate purpose for which the paved surface will be used. In a concrete lining for a canal of approximately four inches in thickness, a suitable joint was constructed which measured approximately 8 inches from one end of the base to the other. In that joint, the water stops reached an approximate height of 1½ inches, and the central projection had a height of about 4 inches.

In operation, a subgrade 28 will be prepared for a water conveyance system such as a canal or reservoir, and a plurality of joints 10 prepared in accordance with the present invention may be laid on the subgrade at regular or desired intervals for the course of the planned structure. The transverse length of joint 10 may be such that a single length will extend across the length of the canal floor, or for wider structures, two or more joints may be laid end-to-end in the subgrade when necessary. The joints 10 are anchored preferably by means of spikes 22 driven into the base 12 at its outer ends. Once the joints are positioned in the subgrade, the pavement may be formed by pouring the concrete out over the length of the subgrade at a height such that the inspection fin tip 24 of central projection 14 ends up at or a small distance above the surface 30 of the concrete lining when formed. It is also possible to reinforce the concrete lining by the placement of steel reinforcements (not shown) prior to placing the concrete.

The present invention can be used in paved linings made of Portland cement concrete or any other material which is similarly subject to contraction and expansion. The joint of the invention is advantageous in that when the pavement hardens, any cracking in the concrete layer 26 will be directed to occur along planes of weaknesses at the interface of adjoining panels around tip 25 of the projection 14, and bonding between the panels is prevented. The use of the joint in this manner protects the concrete from further cracking or buckling, and eliminates deterioration caused by contact between adjoining panels. The concrete pavement thus formed will be of superior stability and durability, and is thus well suited to be used in linings for water conveyance systems.

We claim:

1. A contraction joint for use in a monolithic method of forming a layer of concrete comprising:

a base which can be affixed to the ground;

a central triangular projection extending upwardly from said base so that the height of said projection will approximate the level of the surface of the formed layer of concrete in order to ensure that bonding will not occur between two adjoining panels and eliminate contact at the interface between two adjoining concrete panels, said projection having an upper apex section of uniform thickness and a generally triangular lower section having a cut-out portion to assist in the contraction and expansion of the joint;

a plurality of water stops extending upwardly from said base, at least one of said water stops located on each side of said base away from said central projection; and a plurality of elongated ribs located on said base between said water stops and said central projection, at least one of said ribs located on each side of said central projection.

2. A contraction joint according to claim 1 wherein the water stops are rounded at the top.

3. A contraction joint according to claim 1 wherein the joint is comprised of a durable elastic material.

4. A contraction joint according to claim 3 wherein the joint is comprised of rubber or a rubber-like polymer.

5. A contraction joint according to claim 4 wherein the rubber-like polymer is selected from the group consisting of polyvinylchloride, polyurethane, polyisporene blends, polybutadiene, and ethylene-propylene co- and ter polymers.

6. A contraction joint according to claim 1 which is suitable for use in a concrete-lined water conveyance system.

7. A contraction joint according to claim 6 which is suitable for use in a concrete-lined canal or reservoir.

8. A contraction joint according to claim 1 wherein the base is separable at a point directly below the cut-out portion of said central projection.

9. A contraction joint according to claim 1 wherein the cut-out portion is roughly in the shape of a triangle having a rounded top portion and a rounded bottom portion.

* * * * *